US007163159B2

(12) United States Patent
Joseph

(10) Patent No.: US 7,163,159 B2
(45) Date of Patent: Jan. 16, 2007

(54) FUEL INJECTOR INCLUDING A COMPOUND ANGLE ORIFICE DISC

(75) Inventor: J. Michael Joseph, Newport News, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 36 days.

(21) Appl. No.: 10/618,713

(22) Filed: Jul. 15, 2003

(65) Prior Publication Data

US 2005/0011973 A1 Jan. 20, 2005

(51) Int. Cl.
*F02M 61/00* (2006.01)

(52) U.S. Cl. ..... 239/5; 239/494; 239/497; 239/552; 239/585.5; 239/596; 239/533.12

(58) Field of Classification Search ..... 239/491, 239/494, 497, 533.12, 552, 584, 585.1, 585.4, 239/585.5, 596, 1, 5; 29/890.132, 890.142, 29/890.143
See application file for complete search history.

(56) References Cited

U.S. PATENT DOCUMENTS

| | | | |
|---|---|---|---|
| 335,334 | A | 2/1886 | Brady |
| 600,687 | A | 3/1898 | Flemming |
| 2,737,831 | A | 3/1956 | Webb |
| 2,846,902 | A | 8/1958 | Cowley |
| 4,072,039 | A | 2/1978 | Nakanishi |
| 4,854,024 | A | 8/1989 | Grieb et al. |
| 4,923,169 | A | 5/1990 | Grieb et al. |
| 4,970,926 | A | 11/1990 | Ghajar et al. |
| 5,002,231 | A | 3/1991 | Reiter et al. |
| 5,174,505 | A | 12/1992 | Shen |
| 5,201,806 | A | 4/1993 | Wood |
| 5,335,864 | A | 8/1994 | Romann et al. |
| 5,344,081 | A | 9/1994 | Wakeman |
| 5,365,819 | A | 11/1994 | Maida et al. |
| 5,484,108 | A * | 1/1996 | Nally ..... 239/585.4 |
| 5,489,065 | A | 2/1996 | Nally, Jr. |
| 5,553,397 | A | 9/1996 | Schwitzky et al. |
| 5,365,819 | A | 4/1997 | Maida et al. |

(Continued)

FOREIGN PATENT DOCUMENTS

DE 10034293 A1 7/2001

(Continued)

OTHER PUBLICATIONS

PCT International Search Report filed Jun. 18, 2004 (PCT/US2004/0195047) and date of mailing Nov. 5, 2004.

*Primary Examiner*—Steven J. Ganey

(57) ABSTRACT

A fuel injector includes a metering orifice disc. The metering orifice disc includes a peripheral portion, a central portion, and an orifice. The peripheral portion is with respect to a longitudinal axis and extends parallel to a base plane. The peripheral portion bounds the central portion. The central portion includes a facet that extends parallel to a plane that is oblique with respect to the base plane. The orifice penetrates the facet and extends along an orifice axis that is oblique with respect to the plane. As such, the orientation of the orifice with respect to the longitudinal axis is defined by a combination of (1) a first relationship of the plane with respect to the base plane, and (2) a second relationship of the orifice axis with respect to the plane. A method of forming a multi-facetted dimple for the metering orifice disc is also described.

25 Claims, 5 Drawing Sheets

U.S. PATENT DOCUMENTS

| | | | |
|---|---|---|---|
| 5,636,796 | A | 6/1997 | Oguma |
| 5,697,154 | A | 12/1997 | Ogihara |
| 5,746,376 | A | 5/1998 | Romann et al. |
| 5,816,093 | A | 10/1998 | Takeuchi et al. |
| 5,862,991 | A | 1/1999 | Wilke et al. |
| 5,931,391 | A | 8/1999 | Tani et al. |
| 6,009,787 | A | 1/2000 | Hänggi |
| 6,039,271 | A | 3/2000 | Reiter |
| 6,070,812 | A | 6/2000 | Tani et al. |
| 6,089,476 | A | 7/2000 | Sugimoto et al. |
| 6,131,826 | A | 10/2000 | Teiwes |
| 6,330,981 | B1 | 12/2001 | Nally, Jr. et al. |
| 2001/0017325 | A1 | 8/2001 | Harata et al. |

FOREIGN PATENT DOCUMENTS

| | | |
|---|---|---|
| EP | 1118767 A2 | 10/2001 |
| JP | 3529223121 | 12/1984 |
| JP | 60137529 | 7/1985 |
| JP | 352032192 | 3/1997 |

* cited by examiner

FIG. 1 A
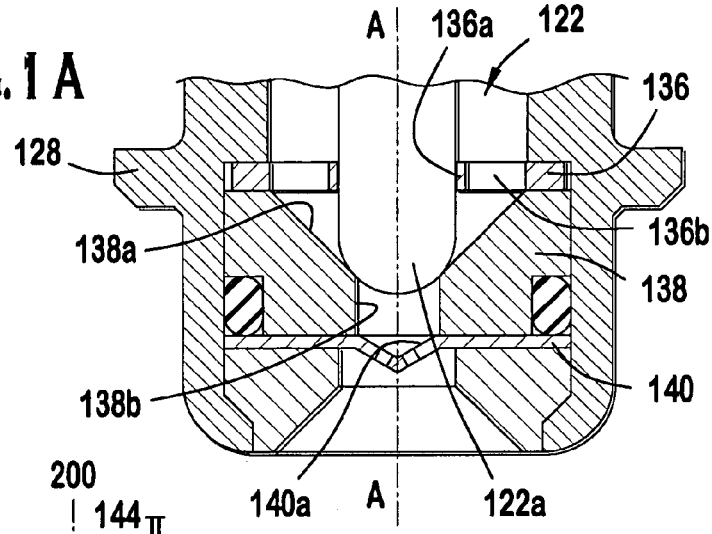
FIG. 1 B
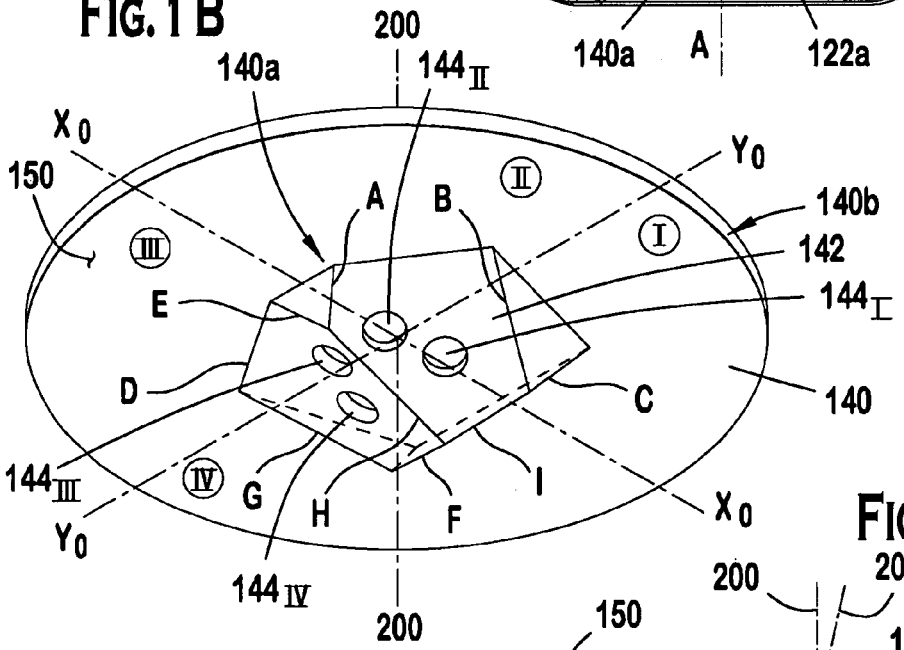
FIG. 2
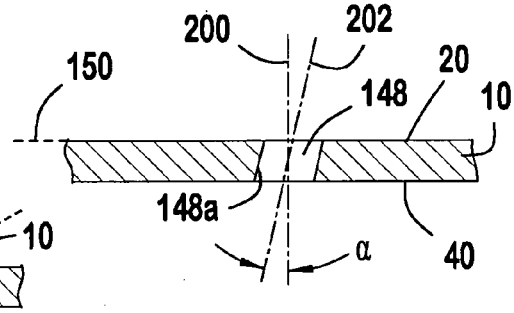
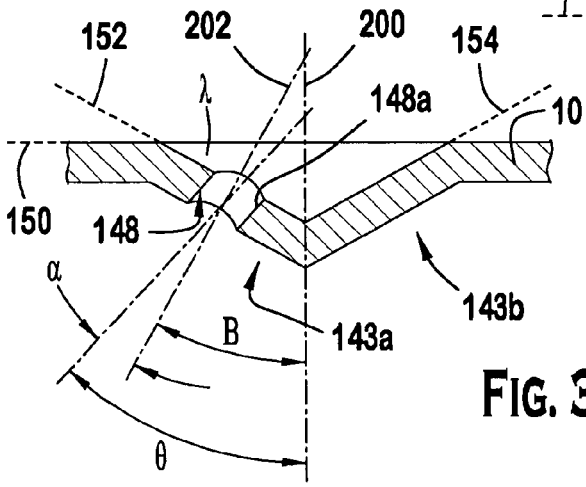
FIG. 3

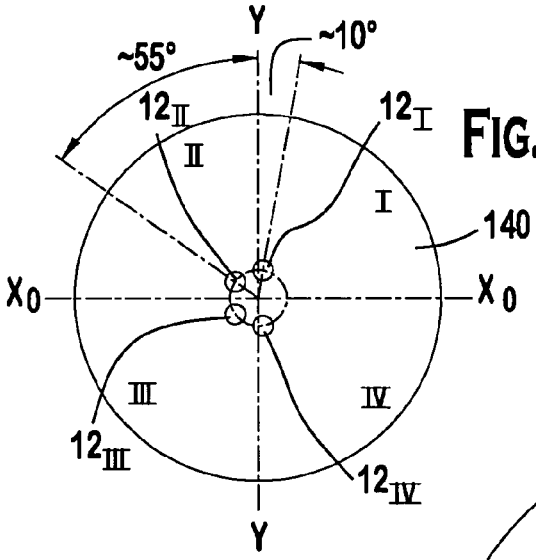
FIG. 4A
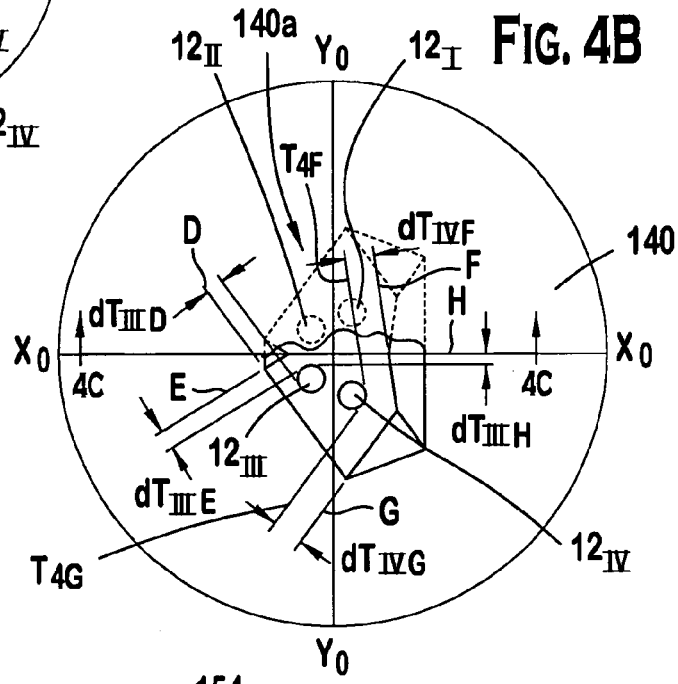
FIG. 4B
FIG. 4C
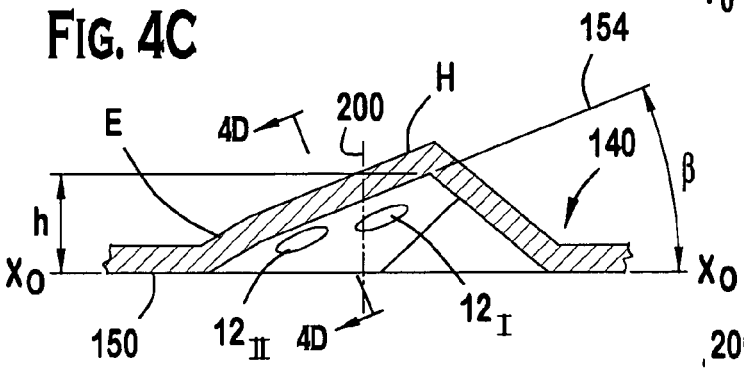
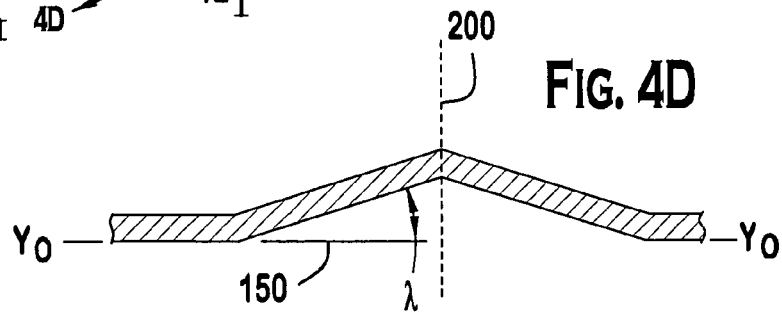
FIG. 4D

FUEL INJECTOR INCLUDING A COMPOUND ANGLE ORIFICE DISC

FIELD OF INVENTION

This invention relates generally to electrically operated fuel injectors of the type that inject volatile liquid fuel into an automotive vehicle internal combustion engine, and in particular the invention relates to a novel thin disc orifice member for such a fuel injector.

BACKGROUND OF THE INVENTION

It is believed that contemporary fuel injectors must be designed to accommodate a particular engine, not vice versa. The ability to meet stringent tailpipe emission standards for mass-produced automotive vehicles is at least in part attributable to the ability to assure consistency in both shaping and aiming the injection spray or stream, e.g., toward intake valve(s) or into a combustion cylinder. Wall wetting should be avoided.

Because of the large number of different engine models that use multi-point fuel injectors, a large number of unique injectors are needed to provide the desired shaping and aiming of the injection spray or stream for each cylinder of an engine. To accommodate these demands, fuel injectors have heretofore been designed to produce straight streams, bent streams, split streams, and split/bent streams. In fuel injectors utilizing thin disc orifice members, such injection patterns can be created solely by the specific design of the thin disc orifice member. This capability offers the opportunity for meaningful manufacturing economies since other components of the fuel injector are not necessarily required to have a unique design for a particular application, i.e. many other components can be of common design.

Another concern in contemporary fuel injector design is minimizing the so-called "sac volume." As it is used in this disclosure, sac volume is defined as a volume downstream of a needle/seat sealing perimeter and upstream of the orifice hole(s). The practical limit of dimpling a geometric shaped into an orifice disc pre-conditioned with straight orifice holes is the depth or altitude of the geometric shape required to obtain the desired spray angle(s). Obtaining the larger bend and split spray angles makes the manufacturing more difficult and increases sac volume at the same time. At the same time, as the depth or height of the geometry increases, the amount of individual hole and dimple distortion also increases. In extreme instances, the disc material may shear between holes or at creases in the geometrical dimple.

It is believed that known metering orifice disc can be formed in the following manner. A flat metering disc is initially formed with an orifice that extends generally perpendicular to the flat metering orifice disc, i.e., a "perpendicular" orifice. In order to achieve a bending or split angle, i.e., an angle at which the orifice is oriented relative to a longitudinal axis of the fuel injector, the region about the orifice is dimpled such that the flat metering orifice disc is no, longer generally planar in its entirety but is now provided with a multi-facetted dimple. As the metering orifice disc is dimpled, the material of the metering orifice disc is forced to yield plastically to form the multi-facetted dimple. The multi-facetted dimple includes at least two sides extending at a dimpling angle, i.e., the angle at which the planar surface of the facet on which the orifice is disposed thereon is oriented relative to the originally flat surface towards an apex. Since the orifice is located on one of the sides, the orifice is also oriented at a bending angle $\beta$. Because the orifice originally extends perpendicularly through the flat surface of the disc, i.e., a "base" plane, a bending angle of the orifice, subsequent to the dimpling, generally approximates the dimpling angle. And depending on the physical properties of the material such as, for example, thickness and yield strength of the material, it is believed that there is an upper limit to the dimpling angle, as too great a dimpling angle can cause the material to shear, rendering the metering orifice disc structurally unsuitable for its intended purpose.

SUMMARY OF THE INVENTION

The present invention relates to novel forms of thin disc orifice members that can enhance the ability to meet different and/or more stringent demands with equivalent or even improved consistency. For example, certain thin disc orifice members according to the invention are well suited for engines in which a single fuel injector is required to direct sprays or stream to one or more intake valve; and thin disc orifice members according to the invention can satisfy difficult installations where space for mounting the fuel injector is severely restricted due to packaging constraints. It is believed that one of the advantages of the invention arises because the metering orifices are located in facetted planar surfaces. This has been found important in providing enhanced flow stability for proper interaction with upstream flow geometries internal to the fuel injector. The presence of a metering orifice in a non-planar surface, such as in a conical dimple, may not be able to consistently achieve the degree of enhanced flow stability that is achieved by its disposition on a facetted planar surface as in the present invention. The particular shape for the indentation that contains the facetted planar surfaces having the metering orifices further characterizes the present invention.

The preferred embodiments of the present invention allow for a desired targeting of fuel spray. The desired targeting of fuel spray is one which is similar to a fuel spray targeting generated by a control case. By virtue of the preferred embodiments, however, a desired spray targeting similar to the spray targeting of the control case can be obtained while providing for a fuel injector that has less sac volume and less material deformation in a metering orifice disc than that of the control case. Consequently, it is believed that the present invention provides a better control of fuel flow and spray angles by virtue of reduced orifice hole distortion, and reduced likelihood of orifice disc material shearing.

The present invention provides a fuel injector for spray targeting fuel. The fuel injector includes a seat, a movable member, and a metering orifice disc. The seat includes a passage that extends along a longitudinal axis. The movable member cooperates with the seat to permit and prevent a flow of fuel through the passage. The metering orifice disc includes first and second surfaces, a peripheral portion, a central portion, and a first orifice. The first surface confronts the seat, and the second surface faces opposite the first surface. The peripheral portion is with respect to the longitudinal axis and extends parallel to a base plane, which is generally orthogonal with respect to the longitudinal axis. The central portion is also with respect to the longitudinal axis and is bounded by the peripheral portion. The central portion includes a first facet that extends parallel to a first plane. The first facet is coupled to the peripheral portion along a first peripheral segment, and the first plane is oblique with respect to the base plane. The first orifice penetrates the first facet and is defined by a first wall that couples the first and second surfaces. The first orifice extends along a first orifice axis that is oblique with respect to the first plane. As such, the orientation of the first orifice with respect to the longitudinal axis is defined by a combination of (1) a first relationship of the first plane with respect to the base plane, and (2) a second relationship of the first orifice axis with respect to the first plane.

The present invention also provides a metering orifice disc for a fuel injector. The fuel injector includes a passage that extends along a longitudinal axis between an inlet and an outlet, a closure member that reciprocates along the longitudinal axis, and a seat that is proximate the outlet and cooperates with the closure member to permit and prevent a flow of fuel through the passage. The metering orifice disc includes a member and an orifice. The member includes first and second generally parallel surfaces. The first surface is adapted to generally confront the valve seat, and the second surface faces opposite the first surface. The member further includes a peripheral portion with respect to the longitudinal axis, and a central portion with respect to the longitudinal axis. The peripheral portion extends parallel to a base plane, and the base plane is generally orthogonal with respect to the longitudinal axis. The central portion is bounded by the peripheral portion and includes a first facet that extends parallel to a first plane. The first facet is coupled to the peripheral portion along a first peripheral segment, and the first plane is oblique with respect to the base plane. The first orifice penetrates the first facet and is defined by a first wall coupling the first and second surfaces. The first orifice extends along a first orifice axis, and the first orifice axis is oblique with respect to the first plane such that an orientation of the first orifice with respect to the longitudinal axis is defined by a combination of (1) a first relationship of the first plane with respect to the base plane, and (2) a second relationship of the first orifice axis with respect to the first plane.

The present invention further provides a method of forming a metering orifice disc for a fuel injector. The metering orifice disc includes first and second surfaces that extend substantially parallel to a base plane and that are spaced along a longitudinal axis extending orthogonal with respect to the base plane. The method can be achieved by: forming a first orifice that penetrates the member; and forming a first facet that extends parallel to a first plane. The first orifice is defined by a first wall that couples the first and second surfaces, and the first orifice extends along a first orifice axis that is oblique with respect to the longitudinal axis. The first orifice penetrates the first facet, and the first plane is oblique with respect to the base plane.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

FIG. 1A is a close-up cross-sectional view of the outlet end portion of the fuel injector of FIG. 1.

FIG. 1B is a perspective view of a multi-faceted dimpled metering orifice disc according to a preferred embodiment as viewed from a fuel exit side of the fuel injector.

FIG. 2 is fragmentary cross-sectional view of a metering orifice disc according to a preferred embodiment of the present invention in an intermediate condition.

FIG. 3 is a fragmentary cross-sectional view of the metering orifice disc according to the preferred embodiment of the present invention, as shown in FIG. 2, in a final condition.

FIGS. 4A and 4B illustrate the dimensions of a metering orifice disc in an initial pre-dimpled configuration to a final dimpled configuration for a control case in comparative analysis that achieves a predetermined spray targeting.

FIGS. 4C and 4D illustrate other dimensions of the thin disc of FIG. 4B.

DETAILED DESCRIPTION OF THE PREFERRED EMBODIMENT(S)

Figure 1:
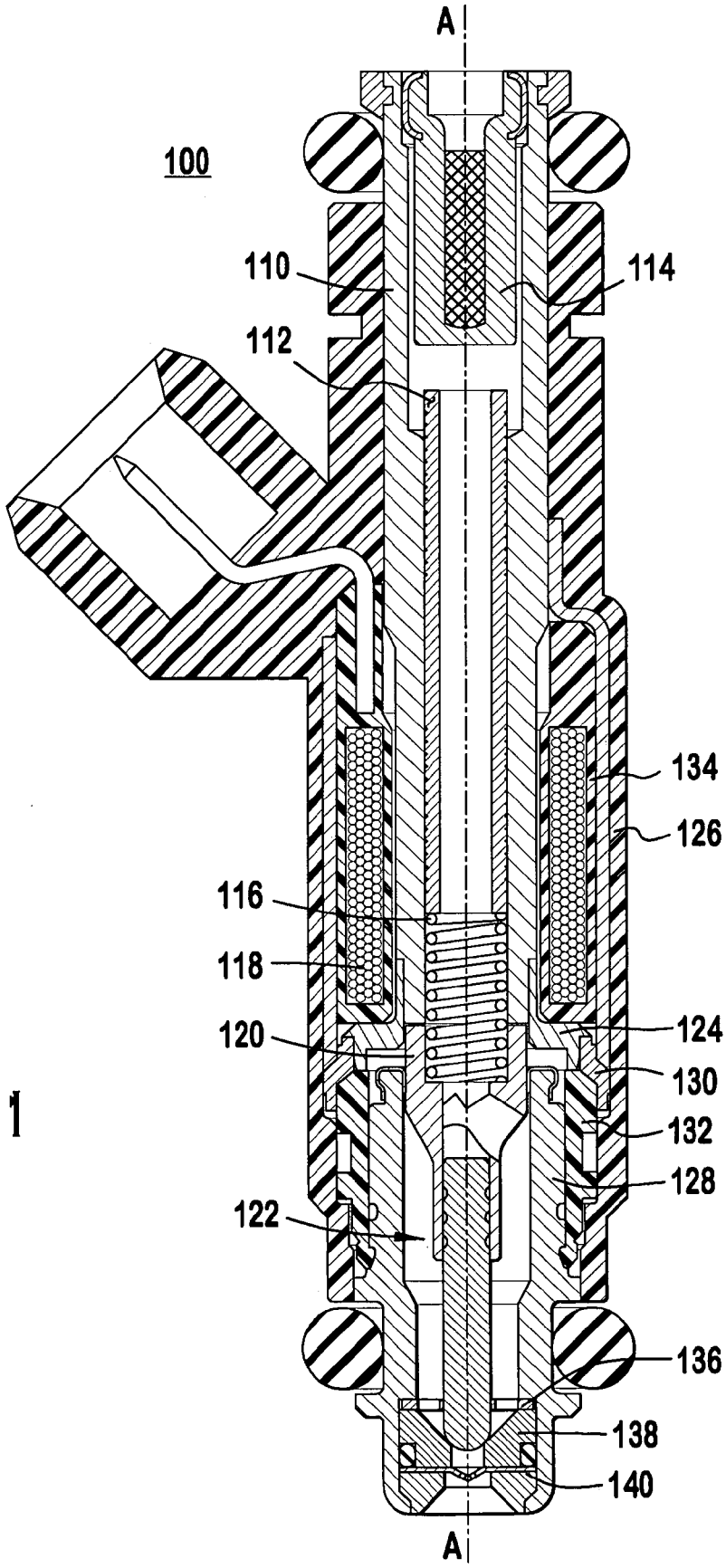
FIG. 1 is a cross-sectional view of a fuel injector according to a preferred embodiment of the present invention.

FIGS. 1–8 illustrate the preferred embodiments. In particular, a fuel injector 100 includes: a fuel inlet tube 110, an adjustment tube 112, a filter assembly 114, a coil assembly 118, a coil spring 116, an armature 120, a closure member assembly 122, a non-magnetic shell 124, a fuel injector overmold 126, a body 128, a body shell 130, a shell overmold 132, a coil overmold 134, a guide member 136 for the closure member assembly 122, a seat 138, and a metering disc 140. The construction of fuel injector 100 can be of a type similar to those disclosed in commonly assigned U.S. Pat. Nos. 4,854,024; 5,174,505; and 6,520,421 with respect to details that are not specifically portrayed in FIGS. 1 and 1A.

FIG. 1A shows the nozzle end of a body 128 of a solenoid operated fuel injector 100 having a metering orifice disc 140 according to a preferred embodiment. The nozzle end of fuel injector 100 includes a guide member 136 and a seat 138, which are disposed axially interiorly of metering orifice disc 140. The guide member 136, seat 138 and disc 140 can be retained by a suitable technique such as, for example, forming a retaining lip with a retainer or by welding the disc 140 to the seat 138 and welding the seat 138 to the body 128.

Seat 138 can include a frustoconical seating surface 138*a* that leads from guide member 136 to a central passage 138*b* of the seat 138 that, in turn, leads to a dimpled central portion 140*a* of metering orifice disc 140. Guide member 136 includes a central guide opening 136*a* for guiding the axial reciprocation of a sealing end 122*a* of a closure member assembly 122 and several through-openings 136*b* distributed around opening 136*a* to provide for fuel to flow into the fuel sac volume discussed earlier. The fuel sac volume is the encased volume downstream of the needle sealing seat perimeter, which is the interface of 122*a* and 138*a*, and upstream of the metering orifices in the area 140*a*. FIG. 1A shows the hemispherical sealing end 122*a* of closure member assembly 122 seated on sealing surface 138*a*, thus preventing fuel flow through the fuel injector.

As shown in FIG. 1A, a volume is defined by the first surface of the metering orifice disc and the sealing end 122*a* cooperating with the seat 138 to prevent the flow of fuel. This volume is generally related to the orientation of the first orifice with respect to the longitudinal axis. That is, with reference to FIGS. 2 and 3, as the first orifice 148 is oriented at increasing angle β relative to axis 200, this volume, also known as the "sac" volume, increases. Conversely, as the first orifice 148 is oriented at decreasing angle β relative to the axis 200, the sac volume decreases.

The metering orifice disc 140, as viewed from outside of the fuel injector in a perspective view of FIG. 1B, has a generally circular shape with a circular outer peripheral portion 140*b* that circumferentially bounds the central portion 140*a* that is disposed axially in the fuel injector.

With reference to FIGS. 2 and 3, the preferred embodiments achieve an increased bending angle, denoted here as bending angle θ, without an increase in a dimpling angle λ that must be applied to the work piece. Briefly, the increased bending angle θ can be formed by initially forming an orifice that is angled to a flat work piece 10 at an orifice angle α, i.e., "angled" orifice, relative to a virtual base plane 150 which is contiguous to at least a portion of disc. Thereafter, the work piece 10 is deformed to form a multi-facetted dimple 143*a* at the same dimpling angle λ as in the conventional dimpled disc. As shown in FIG. 3, however, the new bending angle θ is not related directly as a function of the dimpling angle λ but is related as a function of two angles: (1) the orifice angle α and (2) the dimpling angle λ. Thus, the increased bending angle θ for spray targeting results from approximately the sum of the orifice angle α and the dimpling angle θ.

In the preferred embodiments, the central portion 140*a* of metering orifice disc 140 includes a multi-faceted dimple 143*a* that is bounded by the central portion 140*a*, as shown in FIG. 1B. The central portion 140*a* of metering orifice disc 140 is imperforate except for the presence of one or more orifices 144 via which fuel passes through metering orifice disc 140. Any number of orifices 144 in a suitable array about the longitudinal axis 200 can be configured so that the metering orifice disc 140 can be used for its intended purpose in metering, atomizing and targeting fuel spray of a fuel injector. The preferred embodiments include four such through-orifices $\mathbf{144}_{I}$, $\mathbf{144}_{II}$, $\mathbf{144}_{III}$, $\mathbf{14}_{IV}$, and it can be seen in FIG. 1B, that these orifices can be disposed solely on the planar surfaces of a multi-faceted dimple 142 of the metering orifice disc 140.

Figure 6:
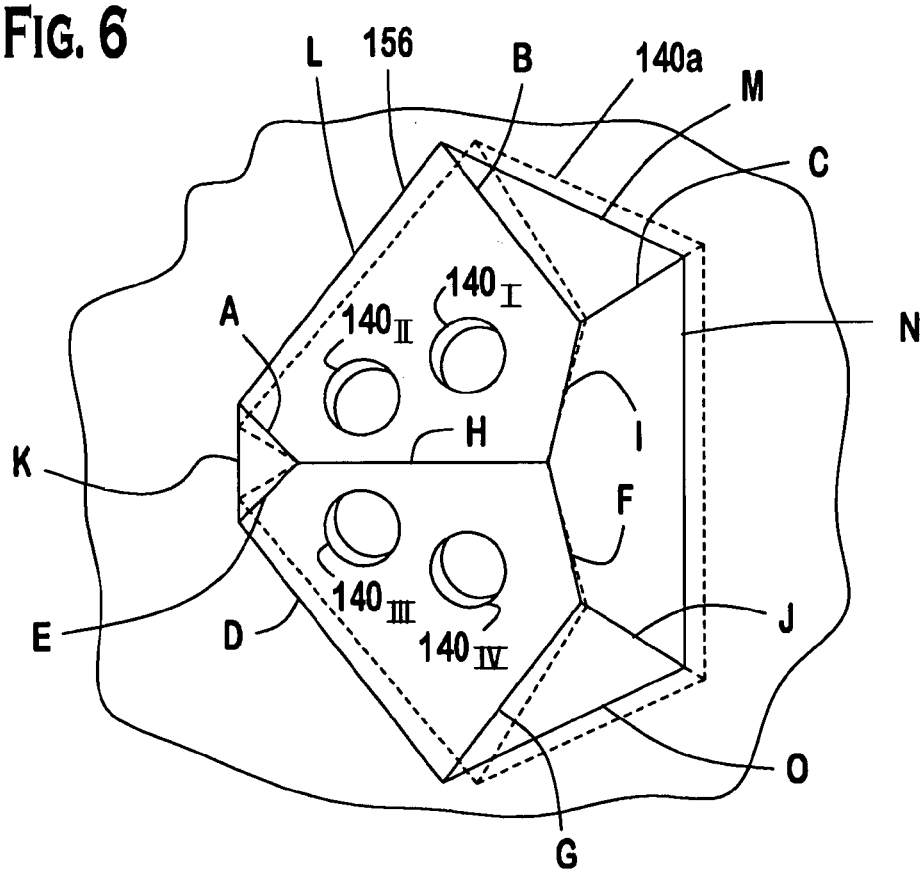
FIG. 6 illustrates a comparison between a configuration of a first preferred embodiment of a metering orifice disc relative to the control case that achieves the same exemplary spray results.

Referencing FIGS. 1B and 6, the multi-faceted dimple 142 of one preferred embodiment includes six generally planar surfaces oblique to a virtual base plane 150 extending between the peripheral and central portions of the metering orifice disc 140. The six generally planar surfaces intersect each other to form various face line or segments denoted as A, B, C, D, E, F, G, H, I, J, K, L, M, N, and O (FIG. 6). The orifices can be located on any one of the facets as long as the facet includes sufficient area for the orifices to be disposed thereon. In the preferred embodiments, two orifices are located on a first facet bounded by segments A, B, H, I, and L, and two other orifices are located on a second facet bounded by segments D, E, F, G, and H. A third facet bounded by segments A, E, and K is contiguous to the first and second facets. A fourth facet bounded by segments J, F, C, I and N is also contiguous to the first and second facets. A fifth facet bounded by segments BMC and its mirror image sixth facet bounded by segments G, J, and O are contiguous to the fourth facet and to either the first or second facets, respectively. Although the third through sixth facets, in the preferred embodiments, are not provided with orifices penetrating through each of the third through sixth facets, these surfaces can be provided with one or more orifices in a suitable application, such as, for example, an intake port with three intake valves.

As provided by the preferred embodiments, the dimpled orifice disc 140 provides for an increase in a spray angle θ relative to a longitudinal axis A—A for each of the orifices without increasing the angle at which a facet is oriented relative to the base plane 150, i.e., a bending angle β or split angle λ (FIG. 4C). That is, the preferred embodiments, including the description of the techniques disclosed herein, allow the metering orifice disc to maintain the same spray targeting and enhance structural rigidity by reduction of significant parameters such as the height of the apex of the dimple with respect to a base plane. And from a performance standpoint, a smaller sac volume can thereby be achieved.

Prior to the formation of the first facet 143*a*, the metering orifice disc 140 includes first and second surfaces 20, 40 that extend substantially parallel to a base plane 150. The first and second surfaces 20 and 40 are spaced along a longitudinal axis 200. The longitudinal axis 200 extends orthogonally with respect to the base plane 150, as shown in FIG. 2. Preferably, the first and second surfaces 20, 40 are spaced apart over a distance of between 75 microns to 300 microns, inclusive of the values thereof.

The preferred embodiments of the metering orifice disc 140 can be formed by a method as follows. The method includes forming a first orifice 148 penetrating the first and second surfaces 20, 40, respectively, and also includes forming a first planar surface or facet 143*a* on which the first orifice 148 is disposed thereon such that the first facet 143*a* extends generally parallel to a first plane 152 oblique to the base plane 150. The first orifice 148 is defined by a first wall 148*a* that couples the first surface 20 and the second surface 40, which are now concave and convex, respectively, as a result of forming the first facet 143*a*. The first orifice 148 extends along a first orifice axis 202 oblique with respect to the longitudinal axis 200. Although the orifice can be formed of a suitable cross-sectional area such as for example, square, rectangular, oval or circular, the preferred embodiments include generally circular orifices having a diameter about 100 microns, and more particularly, about 125 microns. The first orifice 148 can be formed by a suitable technique or a combination of such techniques, such as, for example, laser machining, reaming, punching, drilling, shaving, or coining. Preferably, the first orifice 148 can be formed by stamping and punch forming such that when a dimpling tool deforms the work piece 10, a plurality of planar surfaces oblique to a base plane 150 can be formed. One of the plurality of the planar surfaces can include first facet 143*a*.

Thereafter, a second facet 143*b* can be formed at the same time or within a short interval of time with the first facet 143*a*. The second facet 143*b* can be generally parallel to a second plane oblique 154 to the base plane 150 such that the orifices disposed on the second facet is oblique to the longitudinal axis 200. The second facet 143*b* can also be oblique with respect to the first facet 143*a*. Additional facets can also be formed for the metering orifice disc in a similar manner to provide for a dimple with more than two facets.

In order to quantify the advantages of the preferred embodiments with respect to metering orifice plate that utilizes straight or non-angled orifices prior to the formation of facets (i.e., a control case), comparisons were made with respect to preferred embodiments that utilize angled orifices prior to the formation of facets. The control case was a work piece that utilizes orifices extending perpendicular to the planar surfaces of the work piece, which is deformed to form a plurality of facets. The metering disc of the control case was configured so that it provides a desired fuel spray-targeting pattern under controlled conditions. The test cases, on the other hand, utilize the preferred embodiments at various configurations such that these various configurations permit fuel spray targeting similar to the desired fuel spray targeting under the controlled conditions. That is, even though the physical geometry of each of the test cases was different, the fuel spray targeting of each of the test cases was required to be generally similar to that of the control case. And as used herein, spray targeting is defined as one of a bending angle or a split spray angle relative to the longitudinal axis 200 of a standardized fluid flowing through the fuel injector of the control case and the preferred embodiments at controlled operating conditions, such as, for example, fuel temperature, fuel pressure, flow rate and coil actuation duration.

A metering orifice disc 14 using perpendicular orifices prior to dimpling, i.e., a "pre-dimpled" disc, for the control case is shown in FIG. 4A. The pre-dimpled disc 14 has four orifices $\mathbf{12}_I$, $\mathbf{12}_{II}$, $\mathbf{12}_{III}$, and $\mathbf{12}_{IV}$ located about the geometric center of the metering orifice disc and arrayed such that each of the centers of the orifices are located within respective quadrants I, II, III, and IV for this particular example. Specifically, two of the orifices, denoted here as orifice $\mathbf{12}_I$, and $\mathbf{12}_{IV}$, are symmetrical about centerline $X_0$—$X_0$. Each of orifices $\mathbf{12}_I$ and $\mathbf{12}_{IV}$ is located at, respectively, approximately 10 degrees from centerline Y—Y. Orifices $\mathbf{12}_{II}$, and $\mathbf{12}_{III}$ are also symmetrical about centerline $X_0$—$X_0$ and each is located at approximately 55 degrees from the centerline $Y_0$—$Y_0$. Each of the orifices $\mathbf{12}_I$, $\mathbf{12}_{II}$, $\mathbf{12}_{III}$, and $\mathbf{12}_{IV}$ extends generally perpendicular through disc 14 such that an axis of each of the orifices is generally parallel to the longitudinal axis A—A of the fuel injector prior to being dimpled, and therefore the angle of deviation (i.e., orifice angle $\alpha$) between the axis of each of the orifices $\mathbf{12}_I$, $\mathbf{12}_{II}$, $\mathbf{12}_{III}$, and $\mathbf{12}_{IV}$ with the longitudinal axis is about zero degrees.

The metering orifice disc 140 after dimpling, i.e., a "post-dimpled" metering orifice disc is shown for the control case in FIG. 4B, as viewed from outside of the fuel injector, as a multi-facetted dimple 140*a*. Preferably, the multi-faceted dimple 140*a* includes six generally planar facets that are oblique to a base plane 150 extending through the peripheral portion of the metering orifice disc 140. For comparative purposes, the multi-faceted dimple 140*a* is depicted with various dimensions that reference each of the orifices to various intersecting segments between the facets, which are used as referential datum for this comparison. In particular, a first tangent for orifice $\mathbf{12}_{IV}$ parallel to facet segment "F" with the distance between the tangent and the facet segment F being designated as $dT_{IVF}$; and a second tangent for orifice $\mathbf{12}_{IV}$ parallel to facet segment "G" with the distance between the tangent and the facet segment G being designated as $dT_{IVG}$. A first tangent for orifice $\mathbf{12}_{III}$ parallel to facet segment "H" with the distance between the tangent and the facet segment H being designated as $dT_{IIIH}$; a second tangent for orifice $\mathbf{12}_{III}$, parallel to facet segment "E" with the distance between the tangent and the facet segment E being designated as $dT_{IIIE}$; and a third tangent for orifice $\mathbf{12}_{III}$, parallel to facet segment "D" with the distance between the tangent and the facet segment D being designated as $dT_{IIID}$. Furthermore, the maximum height "h" of the apex of the dimple 143*a*, bending angles $\beta$, and split angle $\lambda$, shown here in FIGS. 4C and 4D, respectively, are also measured. As used herein, the bending angle $\beta$, as applied to a multifaceted dimple, denotes the angle of a dimpled surface with respect to the base plane 150 that tends to orient a flow of fuel through the metering orifices asymmetrically with respect to axis $Y_o$—$Y_o$ and towards two or more sectors. As also used herein, the split angle $\lambda$ denotes the angle of a dimpled surface with respect to the base plane 150 that tends to orient a flow of fuel through the metering orifices symmetrically with respect to axis $X_o$—$X_o$ (FIG. 4D). The magnitudes of the parameters defining the multi-faceted dimple 143*a* are collated in the row labeled as "CONTROL" in Table I below.

TABLE I

Data of Control Case, First, Second, and Third Preferred Embodiments

| I Configuration | II Angle $\alpha$ | III Sac Volume $(mm)^3$ | IV Height "h" of Apex of Facet "H" (mm) | V Bending Angle $\beta$ (degrees) | VI Split Angle $\lambda$ (degrees) | VII $dT_{IVF}$ (mm) | VIII $dT_{IVG}$ (mm) | IX $dT_{IIID}$ (mm) | X $dT_{IIIE}$ (mm) | XI $dT_{IIIH}$ (mm) |
|---|---|---|---|---|---|---|---|---|---|---|
| CONTROL | 0° | 0.812° | 0.56 | 21° | 16° | 0.354 | 0.393 | 0.225 | 0.228 | 0.097 |
| DISC 1 | 6° | 0.726° | 0.491 | 17.7° | 12.8° | 0.228 | 0.284 | 0.341 | 0.268 | 0.093 |
| DISC 2 | 8° | 0.768° | 0.490 | 17.0° | 11.5° | 0.224 | 0.302 | 0.418 | 0.234 | 0.096 |
| DISC 3 | 10° | 0.696° | 0.467 | 16.4° | 10.2° | 0.237 | 0.252 | 0.400 | 0.235 | 0.089 |

Figure 5A:
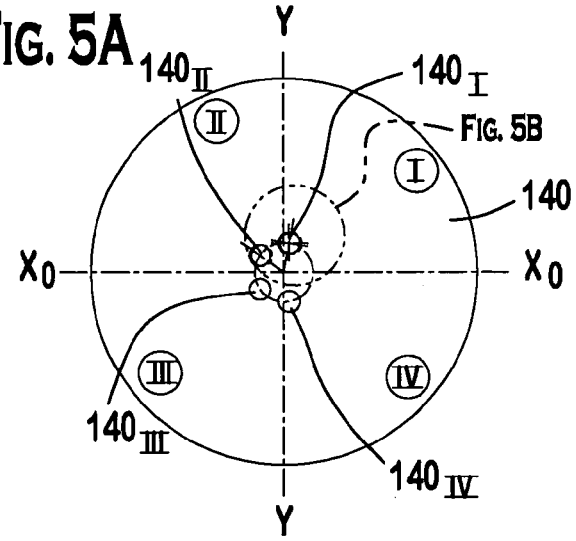
FIGS. 5A and 5B illustrate a metering orifice disc, prior to dimpling, that can be used for the preferred embodiments.
Figure 5B:
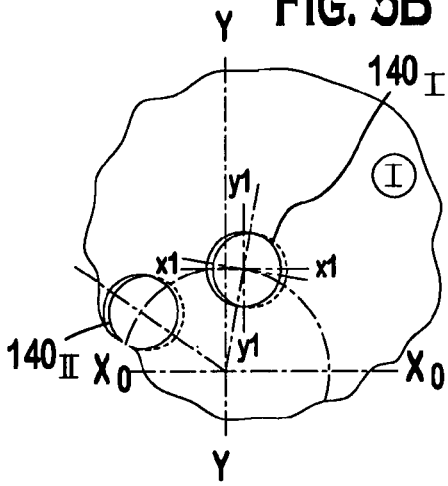

FIG. 5A illustrates a "pre-dimpled" metering orifice disc 140 that can be used for the preferred embodiments. Reference is made with the close-up view of FIG. 5B, which shows two of the four orifices as angled orifices extending through the metering orifice disc at orifice angle $\alpha$ with respect to the longitudinal axis 200 (FIG. 2) of about six degrees (6°). The disc 140 is deformed to form a multi-faceted dimple 156, as shown in solid lines in FIG. 6.

FIG. 6 provides a pictorial comparison of a "post-dimpled" first preferred embodiment (facets depicted as solid lines) 156 with the multi-facetted dimple 140*a* of the control case (depicted as dashed lines). The preferred embodiment of FIG. 6 uses orifices, in the pre-dimpled metering orifice disc, with an orifice angle $\alpha$ of six degrees as measured to the perpendicular axis 200 or its complementary angle of eighty-four degrees (84°) as measured to the base plane 150. It should be noted that the particular configuration of the multi-faceted dimple 156 of FIG. 6 allows the metering orifice disc 140 to obtain approximately the same spray targeting as the control case. Further, it can be seen in the row labeled "Disc 1" of Table I that significant parameters defining the geometry of various facets of the first preferred embodiment as compared to the control case are much smaller in magnitude (as signified by bold notations for each of the parameters in Table I) for the same spray targeting as the control case. The decreases in these significant parameters are believed to be advantageous. The four significant parameters include: the height "h" of apex H; sac volume, bending angle β and split angle λ. For example, the sac volume is reduced by approximately 11%; the bending angle β by 16%; the split angle λ by approximately 20%. And increases in parameters in columns IX and X relating to a distance between a tangent of an orifice relative to a facet line are believed to be advantageous because the orifices are now placed further away from the respective facet line.

Figure 7:
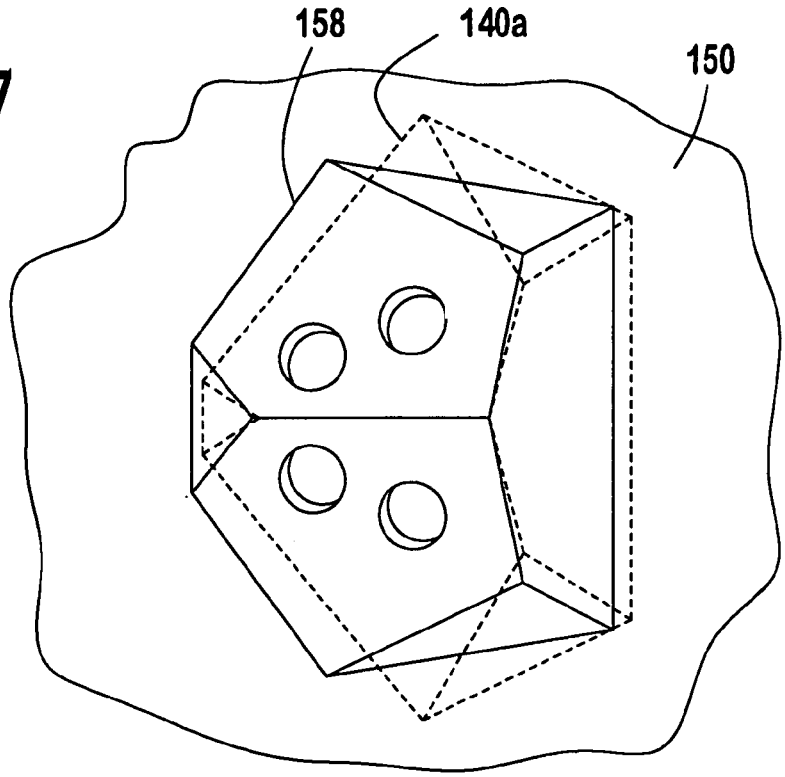
FIG. 7 illustrates a comparison between a configuration of a second preferred embodiment of a metering orifice disc relative to the control case that achieves the same exemplary spray results.

FIG. 7 illustrates a second preferred embodiment of a multi-facet dimple 158 (depicted as solid lines) in comparison with the dimple 140*a* of the control case (designated as dashed lines). The preferred embodiment of FIG. 7 uses orifices, in the pre-dimpled metering orifice disc, with an orifice angle α of eight degrees (8°) as measured to the axis 200 of the pre-dimpled metering orifice disc or its complementary angle of eighty-two degrees (82°) as measured to the base plane 150. Similar to the first preferred embodiment, it can be seen in the row labeled "Disc 2" that significant parameters defining the geometry of various facets of the second preferred embodiment as compared to the control case and the first preferred embodiment are much smaller in magnitude (as signified by bold notations) for the same spray targeting as the control case.

Figure 8:
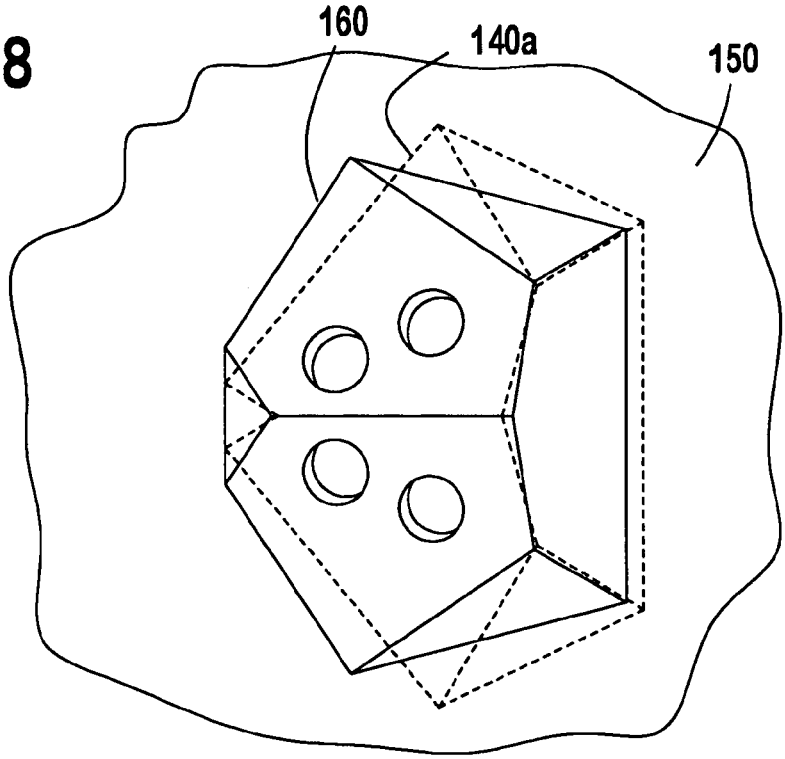
FIG. 8 illustrates a comparison between a configuration of a third preferred embodiment of a metering orifice disc relative to the control case that achieves the same exemplary spray results.

FIG. 8 illustrates a third preferred embodiment (depicted as solid lines) of a multi-facetted dimple 160 in comparison with the dimple 140*a* of the control case (designated as dashed lines). The preferred embodiment of FIG. 8 uses orifices, in the pre-dimpled metering orifice disc, with an orifice angle α of ten degrees as measured with respect to the longitudinal axis 200 or its complementary angle of eighty degrees (80°) as measured to the base plane 150. It should be noted that the particular configuration of the multi-faceted dimple 160 of FIG. 8 allows the metering orifice disc 140 of FIG. 8 to obtain approximately the same spray targeting as the control case. Similar to the first and second preferred embodiments, it can be seen in the row labeled "Disc 3" that significant parameters defining the geometry of various facets of the third preferred embodiment as compared to the control case, the first and second preferred embodiments are much smaller in magnitude (as signified by bold notations) for the same spray targeting as the control case. Additionally, it should be noted that a trend can be seen in Table I in that the significant parameters should be decreased when the angle α of an orifice relative to an axis 200 is increased prior to dimpling.

The comparative analysis above is believed to illustrate the advantages of the present invention in allowing for at least a reduced sac volume, apex height "h", bending angle β and split angle λ while maintaining the same spray targeting of a control case that uses perpendicular orifices in the pre-dimpled metering orifice disc. Furthermore, by comparisons with a control case, it can be seen that the preferred embodiments permit generally the same desired fuel spray targeting previously achievable with a control case yet with better fuel injector characteristics such as, for example, sac volume, lower material distortion or failure of the metering disc during the manufacturing process. Moreover, it can be seen that the spray angle θ of each of the orifices is now a result of at least two angles (orifice angle α and at least one of the bending angle β and split angle λ) such that extreme cases of orifice geometry can be manufactured without causing any reduction in structural integrity of the metering orifice disc 140 while also reducing the sac volume, the height of the apex and the amount of dimpling force or stress applied to the metering orifice disc without impairing the strength or integrity of the metering disc.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

I claim:

1. A fuel injector for metering, atomizing, and spray targeting fuel, the fuel injector comprising:

a seat including a passage extending along a longitudinal axis;

a movable member cooperating with the seat to permit and prevent a flow of fuel through the passage; and a metering orifice disc including:

first and second surfaces, the first surface confronting the seat, and the second surface facing opposite the first surface;

a peripheral portion with respect to the longitudinal axis, the peripheral portion extending parallel to a base plane, and the base plane being generally orthogonal with respect to the longitudinal axis, the base plane comprising an interface of the seat and a peripheral portion of the first surface;

a central portion with respect to the longitudinal axis, the central portion being bounded by the peripheral portion and including a first facet extending parallel to a first plane, the first facet being coupled to the peripheral portion along a first peripheral segment, and the first plane being oblique with respect to the base plane; and a first orifice penetrating the first facet and being defined by a first wall coupling the first and second surfaces, the first orifice extending along a first orifice axis, and the first orifice axis being oblique with respect to the first plane such that an orientation of the first orifice with respect to the longitudinal axis is defined by a combination of a first relationship of the first plane with respect to the base plane and a second relationship of the first orifice axis with respect to the first plane, wherein the central portion of the first surface comprises an apex and a perpendicular height of the apex with respect to the base plane, and there is a generally direct correlation between the apex height and the orientation of the first orifice with respect to the longitudinal axis.

2. The fuel injector according to claim 1, wherein the first surface is generally parallel to the second surface.

3. The fuel injector according to claim 1, wherein the first surface and second surface comprise a planar surface extending away from the seat and oblique to the longitudinal axis.

4. The fuel injector according to claim 1, wherein the first surface and second surface comprise a planar surface extending towards the seat and oblique to the longitudinal axis.

5. The fuel injector according to claim 3, wherein a sac volume is defined by the first surface of the metering orifice disc and the member cooperating with the seat to prevent the flow of fuel, and there is a generally direct correlation between the sac volume and the orientation of the first orifice with respect to the longitudinal axis.

6. A metering orifice disc for a fuel injector including a passage extending along a longitudinal axis between an inlet and an outlet, a closure member reciprocating along the longitudinal axis, and a seat proximate the outlet and cooperating with the closure member to permit and prevent a flow of fuel through the passage, the metering orifice disc comprising:

a member including first and second generally parallel surfaces, the first surface being adapted to generally confront the valve seat, and the second surface facing opposite the first surface, the member including:

a peripheral portion with respect to the longitudinal axis, the peripheral portion extending parallel to a base plane, and the base plane being generally orthogonal with respect to the longitudinal axis;

a central portion with respect to the longitudinal axis, the central portion being bounded by the peripheral portion and including a first facet extending parallel to a first plane, the first facet being coupled to the peripheral portion along a first peripheral segment, and the first plane being oblique with respect to the base plane; and a first orifice penetrating the first facet and being defined by a first wall coupling the first and second surfaces, the first orifice extending along a first orifice axis, and the first orifice axis being oblique with respect to the first plane such that an orientation of the first orifice with respect to the longitudinal axis is defined by a combination of a first relationship of the first plane with respect to the base plane and a second relationship of the first orifice axis with respect to the first plane, wherein the central portion of the first surface comprises an apex and a perpendicular height of the apex with respect to the base plane, and there is a generally direct correlation between the apex height and the orientation of the first orifice with respect to the longitudinal axis.

7. The metering orifice disc according to claim 6, wherein the central portion of the member comprises a second facet extending parallel to a second plane, the second facet being coupled to the peripheral portion along a second peripheral segment, and the second plane being oblique with respect to the base plane.

8. The metering orifice disc according to claim 7, wherein the second plane being oblique with respect to the first plane.

9. The metering orifice disc according to claim 8, wherein the second facet is coupled to the first facet along a first central segment.

10. The metering orifice disc according to claim 7, further comprising:

a second orifice penetrating the second facet and being defined by a second wall coupling the first and second surfaces, the second orifice extending along a second orifice axis, and the second orifice axis being oblique with respect to the second plane such that an orientation of the second orifice with respect to the longitudinal axis is defined by a combination of a third relationship of the second plane with respect to the base plane and a fourth relationship of the second orifice axis with respect to the second plane.

11. The metering orifice disc according to claim 10, wherein the second orifice axis is oblique with respect to the first orifice axis.

12. The metering orifice disc according to claim 11, wherein the longitudinal, first orifice, and second orifice axes are intersecting.

13. The metering orifice disc according to claim 10, wherein the central portion of the member comprises a third facet extending parallel to a third plane, the third facet being coupled to the peripheral portion along a third peripheral segment, and the third plane being oblique with respect to the base plane.

14. The metering orifice disc according to claim 13, wherein the third facet is non-penetrated, and the third facet is coupled to at least one of the first facet along a second central segment and the second facet along a third central segment.

15. The metering orifice disc according to claim 14, wherein the third facet is coupled to the first and second facets along the second and third central segments, respectively.

16. The metering orifice disc according to claim 6, wherein the first surface and second surface comprise a planar surface extending away from the seat and oblique to the longitudinal axis.

17. The metering orifice disc according to claim 6, wherein the first surface and second surface comprise a planar surface extending towards the seat and oblique to the longitudinal axis.

18. The metering orifice disc according to claim 6, wherein the first orifice has a diameter ranging between approximately 125 microns to approximately 600 microns.

19. A method of forming a metering orifice disc for a fuel injector, the metering orifice disc including a member including first and second surfaces extending substantially parallel to a base plane, the first and second surfaces being spaced along a longitudinal axis extending orthogonal with respect to the base plane, the first surface comprising an apex and a perpendicular height of the apex with respect to the base plane, the method comprising:

forming a first orifice penetrating the member, the first orifice being defined by a first wall coupling the first and second surfaces, and the first orifice extending along a first orifice axis oblique with respect to the longitudinal axis;

forming a first facet extending parallel to a first plane, the first facet being penetrated by the first orifice, and the first plane being oblique with respect to the base plane; and ensuring that a generally direct correlation exists between the height of the apex and the orientation of the first orifice with respect to the longitudinal axis.

20. The method according to claim 19, wherein the forming the first orifice comprises at least one of punching, drilling, shaving, and coining.

21. The method according to claim 19, wherein the forming the first facet comprises at least one stamping and punch forming.

22. The method according to claim 19, comprising:

forming a second orifice penetrating the member so provided, the second orifice being defined by a second wall coupling the first and second surfaces, and the second orifice extending along a second orifice axis oblique with respect to the longitudinal axis.

23. The method according to claim 22, wherein the forming the member so penetrated comprises forming a second facet extending parallel to a second plane, the second facet being penetrated by the second orifice, and the second plane being oblique with respect to the base plane.

24. The method according to claim 23, wherein the forming the member so penetrated comprises forming a third facet extending parallel to a third plane, and the third plane being oblique with respect to the base plane.

25. The method according to claim 24, wherein the forming the member so penetrated comprises forming the first surface as a concave surface and forming the second surface as a convex surface.

* * * * *